US005341669A

United States Patent [19]

Katz

[11] Patent Number: 5,341,669

[45] Date of Patent: Aug. 30, 1994

[54] ROTARY BENDING TOOL WITH CONTINUOUS LUBRICATION

[75] Inventor: Wolfgang Katz, Dauchingen, Fed. Rep. of Germany

[73] Assignee: Ready Tools, Inc., Dayton, Ohio

[21] Appl. No.: 15,538

[22] Filed: Feb. 8, 1993

[30] Foreign Application Priority Data

Feb. 8, 1992 [DE] Fed. Rep. of Germany ..... 4203680

[51] Int. Cl.[5] ..... B21D 5/01

[52] U.S. Cl. ..... 72/387; 72/313

[58] Field of Search ..... 72/312, 313, 319, 320, 72/387, 388

[56] References Cited

U.S. PATENT DOCUMENTS 4,002,049 1/1977 Randolph, Sr. ..... 72/388
4,181,002 1/1980 Eckhold et al. ..... 72/387
4,434,644 3/1984 Gargrave et al. ..... 72/387
4,535,619 8/1985 Gargrave ..... 72/313

FOREIGN PATENT DOCUMENTS 0370582 5/1990 European Pat. Off. .
0427886 5/1991 European Pat. Off. .

*Primary Examiner*—David Jones
*Attorney, Agent, or Firm*—Irvin A. Lavine

[57] ABSTRACT

A rotary bending tool, consisting of a rotary bending head, a saddle block with bearing surfaces and retaining key for holding the rotary bending head, a restoring member for the rotary bending head and a bottom die, the bearing assembly of the rotary bending head being equipped with a continuous lubricating device. The continuous lubricating device consists preferably of lubricant chambers, which are fed via a lubricant-delivery duct. Preferably the restoring member for the rotary bending head is integrated in the lubricant-delivery duct.

15 Claims, 1 Drawing Sheet

ROTARY BENDING TOOL WITH CONTINUOUS LUBRICATION

The invention relates to a rotary bending tool.

Rotary bending tools of this type are used in presses, as are known, for example, from U.S. Pat. No. 4,002,049. In such presses, the forming action is exerted by combined rotational and translational movements of the tool. The tool consists of a rotary bending head in the form of a cylinder with an approximately V-shaped recess, the angle between the two arms of the V-shaped recess being determined largely by the bend angle of the formed component to be bent and in most cases being on the order of magnitude of 90°.

The rotary bending head and its V-shaped recess cooperates with a correspondingly shaped bottom die, the bent component to be shaped being formed around the bottom die by the recess in the rotary bending head. In the process, the rotary bending head is first subjected to a translational movement by the descending saddle block in which it is pivotably mounted, a rotational movement being superposed on the translational movement during the actual shaping process. The bearing assembly of the rotary bending head in the saddle block is therefore of the utmost importance, since not only does it transmit the pressing pressure, but at the same time it must permit the rotary bending head to rotate as smoothly as possible.

This bearing assembly initially consisted of an approximately semicircular recess in the saddle block, into which recess the rotary bending head was inserted. To facilitate the rotational movement, lubricants were introduced into the approximately semicircular recess only upon initial assembly. However, it was found that this type of lubrication is not nearly adequate, because the lubricant is forced out of the bearing zone after a very short time. Because of the resulting dry-running of the bearing assembly, the resistance increases rapidly, and in turn the force necessary for forming increases steadily with length of service time. Even after relatively short use, the danger exists of seizing of the rotary bending head in the saddle block.

A modified bearing assembly intended to overcome this problem has already been proposed in U.S. Pat. No. 4,434,644. Therein the rotary bending head is no longer held over its full surface in the substantially semicircular recess of the saddle block, but instead it rests on a plurality of slide ridges. These slide ridges have the form of sector-shaped projections of an otherwise semicircular recess in the saddle block. The rotary bending head is in contact with only these ridges, three of four of which, for example, are provided.

The saddle block is also provided with a wedge-shaped insert, the position of which is adjustable relative to the saddle block. The tapering face of the wedge-shaped insert fulfills the function of a further bearing surface. The adjustability of the wedge insert permits exact adjustment of the bearing play of the rotary bending head in the saddle block.

A further improvement of this appliance is that a slot containing a lubricant-impregnated cord is provided in the saddle block and also in the wedge insert. The slot is designed to enclose the cord over about three quarters of its circumference. The remaining quarter of the cord is in contact with the rotary bending head. By virtue of the reciprocating movement of the rotary bending head, lubricant is discharged from the impregnated cord. The two lubricant-impregnated cords are disposed approximately 180° apart in the hope of ensuring that more or less the entire cylindrical surface of the rotary bending head will be adequately supplied with lubricant.

It has now been found that sufficiently stable bearing of the rotary bending head in the saddle block cannot be guaranteed even with this improved appliance. An improvement is indeed achieved in that the two cords transfer lubricant to the cylindrical surface and thus the bearing surface during each rotational movement of the rotary bending head, but the effect declines relatively rapidly even in this configuration, since the absorption capacity of the cords for lubricant is very limited. The lubricant supply is therefore used up very rapidly. Even the lubrication in this appliance is so-called one-time lubrication, since the lubricant-impregnated cords are inserted during assembly of the appliance. Provisions have not been made for replacement of the cords during operation of the appliance, but instead the tool must be completely dismantled.

A further disadvantage of this type of lubrication is the abrasive stripping of cord material, which inevitably sticks between the bearing surfaces of the saddle block and the cylindrical surface of the rotary bending head. For example, the cord usually consists of fibrous material, which has a relatively high absorption capacity for the lubricant. However, the fibers have the characteristic that they are torn very easily from the fiber aggregate while the rotary bending head is sliding past. Because of the adhesion of the lubricant, they first remain stuck to the surface of the rotary bending head and are drawn into the zones of contact with the bearing surfaces of the saddle block. There they cause increased resistance and wear.

The object of the present invention is therefore to provide a rotary bending head in accordance with the precharacterizing clause, in which head the above mentioned problems no longer occur.

According to the invention, the object is achieved with a rotary bending head according to claim 1. Advantageous embodiments are defined in the subclaims.

The invention is based on the idea of providing and integrating in the saddle block a continuous lubricating system for the bearing assembly of the rotary bending head. Therewith the advantage is obtained that adequate supply with lubricant is possible during the entire operating period of the rotary bending tool. A decline of the lubricating effect or even dry-running of the bearing assembly is no longer a possibility. The service life of the rotary bending tool can therefore be extended enormously. The life-determining factor is now no longer the bearing assembly of the rotary bending head in the saddle block, but the durability of the bending surfaces, i.e., the V-shaped recess of the rotary bending head and the mating surfaces of the bottom dies.

BRIEF DESCRIPTION OF THE DRAWINGS

The invention will be further explained by reference to the figures, wherein.

DESCRIPTION OF THE PREFERRED EMBODIMENT

Figure 1:
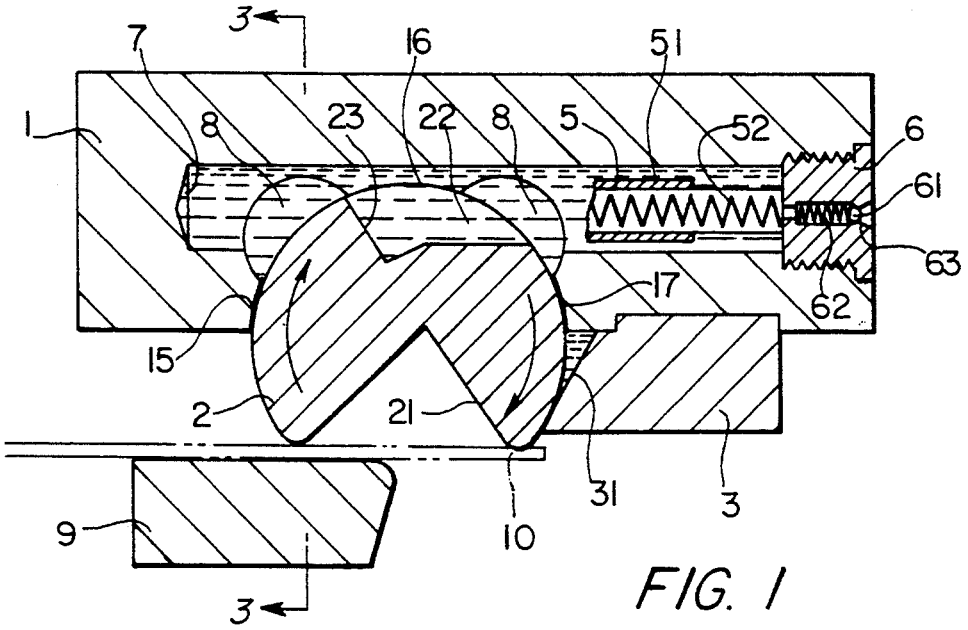
FIG. 1 shows the rotary bending tool in the position at the start of the bending process.
Figure 2:
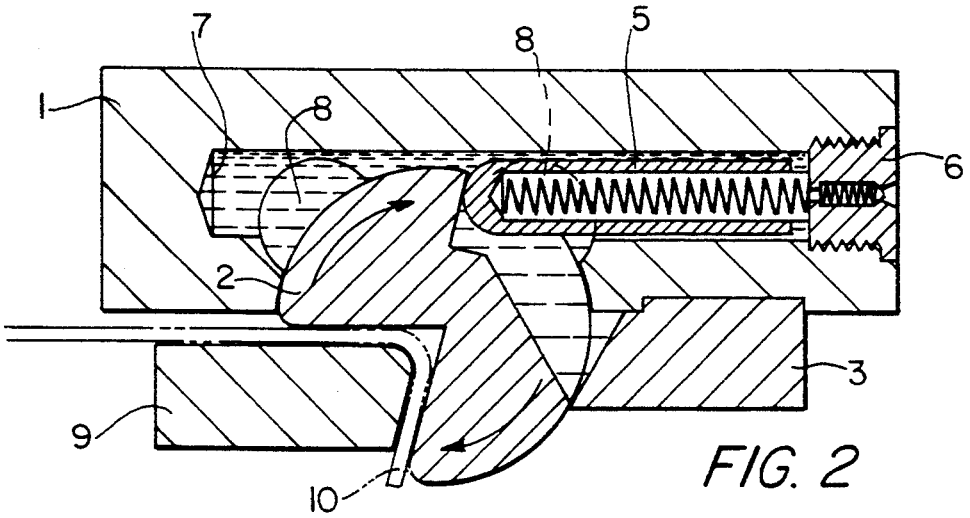
FIG. 2 shows the rotary bending tool in the position at the end of the bending process.
Figure 3:
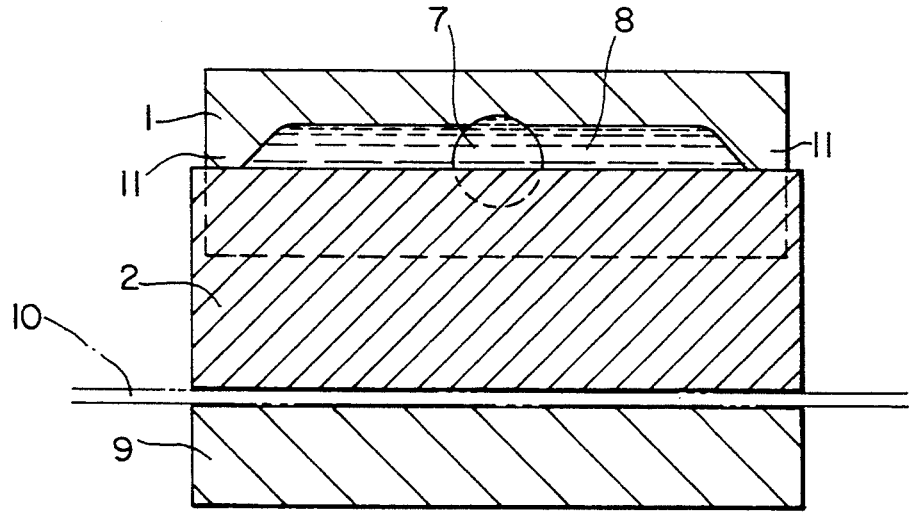
FIG. 3 shows the rotary bending tool in section 3—3 of FIG. 1.

The core piece of the rotary bending tool is the rotary bending head 2. It has a substantially V-shaped recess 21, which extends over the entire length of the rotary bending head. The angle between the two arms of the V-shaped recess depends on which bend angle will be imparted to the bent component. The most frequent application involves imparting a right angle to the bent component. In this case, the angle between the surfaces of the two arms will also be approximately 90°.

The rotary bending head is mounted in a saddle block 1, the bearing surfaces 15, 16, 17 being formed by circular arcs. These bearing surfaces are disposed in such a way in the saddle block that they support the rotary bending head substantially in an angular range of about 180°. A retaining key 3 is attached to the saddle block in a manner not illustrated in further detail. The face 31 thereof is shaped such that, at its tapering end, it constitutes a further bearing zone for the rotary bending head 2. By means not shown in further detail here, the retaining key can be positionally varied and fixed relative to the rotary bending head 2 and thus also relative to the saddle block 1. Thereby it is possible to adjust the bearing play of the rotary bending head 2.

The rotary bending head 2 is also provided with a slot 22 containing a mating surface 23. In this slot 22 there engages a restoring member 5. The restoring member 5 consists substantially of a plunger 51, which is pressed by the preload force of a spring 52 against the mating surface 23 of the rotary bending head 2.

The rotary bending head 2 cooperates with a bottom die 9, which is shaped to conform to the V-shaped recess 21 of the rotary bending head 2. By translation and simultaneous rotation of the rotary bending head 2, the bent component 10 is bent around the bottom die 9, the bend angle being determined by the angle of the V-shaped recess 21.

In the initial position according to FIG. 1, the rotary bending tool is positioned directly at the start of the deformation process. The rotary bending head 2 rests on the bent component 10 and presses the bent component 10 against the bottom die 9. The front end of the plunger 51 presses by spring force against the mating surface 23 (not illustrated here).

During translation of the saddle block 1 in the direction of arrow M, the rotary bending head 2 executes a forced rotational movement, which continues until the bent component 10 has been bent around the bottom die 9 and has been brought into contact on all sides between the bottom die 9 and the V-shaped recess 21.

During the rotational movement of the rotary bending head 2, the plunger 51 pressing against the mating surface 23 is pushed to the right, thus compressing the spring 52.

Upon completion of the bending process, the rotary bending head 2 is raised together with the saddle block 1 in the direction opposite that of arrow M. The plunger 51, supported by the spring 52, ensures that the rotary bending head 2 is pushed back to its initial position during the return movement. A stop not illustrated in more detail here ensures that the rotary bending head 2 cannot be turned back beyond the initial position.

The bearing surfaces 15, 16, 17 are supplied with lubricant from the lubricant chambers 8. These are each located between the bearing surfaces 15, 16, 17 and are integrated in the saddle block. The volume of the lubricant chambers can be dimensioned such that an adequate lubricant supply can be introduced for a specified life of the rotary bending tool.

In a preferred embodiment, a lubricant-delivery duct 7, in the form, for example, of a drill hole, is provided in the saddle block 1. It forms an extension of and opens into the lubricant chamber 8 and thus permits the delivery of further lubricant even during operation. In this case, the volume of the lubricant chamber 8 can be kept relatively small, because continuous or even batchwise addition of lubricant is possible even during continuous operation of the rotary bending tool.

For optimum supply of the bearing zones, it is advantageous for the lubricant chambers 8 to extend substantially over the entire axial length of the rotary bending head 2 to be held in bearings. End closures 11 ensure that both escape of oil and ingress of contaminants are prevented.

The end closures 11 can be made simply by caulking the openings, which initially extend completely through in the axial direction.

For uniform delivery of lubricant it may be necessary to provide a plurality of lubricant-delivery ducts 7 in parallel arrangement. It is also possible to provide a plurality of continuous lubricating devices. This is particularly appropriate when the rotary bending tool has an extremely large axial length.

The lubricant-delivery duct 7 can be closed at the end with a plug 6. Construction in the form of a blind plug is adequate for cases in which refilling with lubricant is necessary only at very long time intervals.

For relatively frequent refilling processes, it is advantageous to construct the plug 6 as a type of lubricating nipple. In this case, a valve ball 61, supported by a spring 63, rests on a valve seat 63 provided in the plug 6.

In a further embodiment, the lubricant-delivery duct 7 is in communication with a central lubricant-supply system, which is not shown in more detail here. In this case, fully automatic continuous supply of the bearing zones with lubricant is ensured.

In a preferred embodiment, the restoring member 5 is disposed coaxially in the lubricant-delivery duct 7. By this expedient it is ensured that the zone of contact between plunger 51 and mating surface 23 is permanently supplied with lubricant.

Depending on the application, the lubricant can be conventional oils or greases or even completely synthetic lubricants.

I claim:

1. A rotary bending tool comprising:

a saddle block having cylindrical bearing surfaces, a rotary bending head having cylindrical surfaces journalled by the cylindrical bearing surfaces of said saddle block, a retaining key carried by said saddle block having a bearing surface for retaining said rotary bending head, a member in said saddle block for restoring said rotary bending head to an initial position after rotation thereof in said saddle block, a die for engagement by a component to be deformed by said rotary bending head, at least one lubricant chamber in said saddle block in fluid communication with said bearing surfaces and having an extension to an exterior surface of said saddle block to enable lubricant to be introduced into said lubricant chamber from the exterior of said bending tool, and a plug in said saddle block for closing said extension of said lubricant chamber.

2. The rotary bending tool as claimed in claim 1, said extension comprising a lubricant delivery duct in fluid communication with each said lubricant chamber.

3. The rotary bending tool as claimed in claim 1, wherein said at least one lubricant chamber extends substantially over the entire axial length of said cylindrical bearing surfaces.

4. The rotary bending tool as claimed in claim 3, there being a plurality of said extension in said saddle block in fluid communication with said at least one lubricant chamber.

5. The rotary bending tool as claimed in claim 4, wherein said saddle block has multiple lubricant chambers therein in fluid communication with said extensions.

6. The rotary bending tool as claimed in claim 1, said plug having a spring-urged ball valve therein to retain lubricant in said extension and to permit lubricant to be forced into said extension.

7. The rotary bending tool as claimed in claim 1, wherein each said lubricant chamber extends along the axial length of said rotary bending head, and a central extension being in fluid communication with each said lubricant chamber.

8. The rotary bending tool as claimed in claim 1, wherein said restoring member comprises a plunger in engagement with a surface of said bending tool and a spring urging said plunger against said surface of said bending tool.

9. A rotary bending tool comprising:

a saddle block having cylindrical bearing surfaces, a rotary bending head having cylindrical surfaces journalled by the cylindrical bearing surfaces of said saddle block, a retaining key carried by said saddle block having a bearing surface for retaining said rotary bending head, a member in said saddle block for restoring said rotary bending head to an initial position after rotation thereof in said saddle block;

a die for engagement by a component to be deformed by said rotary bending head, at least one lubricant chamber in said saddle block in fluid communication with said bearing surfaces and having an extension to an exterior surface of said saddle block, and fluid lubricant located in said lubricant chamber.

10. The rotary bending tool as claimed in claim 9, said extension comprising a lubricant delivery duct in fluid communication with each said lubricant chamber.

11. The rotary bending tool as claimed in claim 9, wherein said at least one lubricant chamber extends substantially over the entire axial length of said cylindrical bearing surfaces.

12. The rotary bending tool as claimed in claim 11, there being a plurality of said extensions in said saddle block in fluid communication with said at least one lubricant chamber.

13. The rotary bending tool as claimed in claim 12, wherein said saddle block has multiple lubricant chambers therein in fluid communication with said extensions.

14. The rotary bending tool as claimed in claim 9, wherein each said lubricant chamber extends along the axial length of said rotary bending head, and a central extension being in fluid communication with each said lubricant chamber.

15. The rotary bending tool as claimed in claim 9, wherein said restoring member comprises a plunger in engagement with a surface of said bending tool and a spring urging said plunger against said surface of said bending tool.

* * * * *